US006297465B1

(12) United States Patent
Groves et al.

(10) Patent No.: US 6,297,465 B1
(45) Date of Patent: Oct. 2, 2001

(54) TWO PIECE MOLDED ARC CHUTE

(75) Inventors: David Herman Groves; Justin Matthew Dravis, both of Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/578,668

(22) Filed: May 25, 2000

(51) Int. Cl.[7] ..... H01H 33/02
(52) U.S. Cl. ..... 218/156; 218/151
(58) Field of Search ..... 218/15, 34, 35, 218/38, 76, 81, 90, 149, 151, 156, 157

(56) References Cited

U.S. PATENT DOCUMENTS

| | | | | |
|---|---|---|---|---|
| 2,243,038 | * | 5/1941 | Ludwig | 218/7 |
| 2,363,606 | * | 11/1944 | Maseng | 218/7 |
| 2,468,422 | * | 4/1949 | Wood | 218/152 |
| 2,477,189 | * | 7/1949 | Lerstrup | 218/7 |
| 2,590,543 | * | 3/1952 | Kalaway | 218/34 |
| 2,648,742 | * | 8/1953 | Edmunds | 218/151 |
| 2,687,462 | * | 8/1954 | Cellerini | 218/157 |
| 2,942,083 | * | 6/1960 | Walker et al. | 218/157 |
| 3,662,133 | | 5/1972 | Bould et al. . | |
| 4,056,798 | | 11/1977 | Malick . | |
| 4,743,720 | | 5/1988 | Takeuchi et al. . | |
| 4,963,849 | | 10/1990 | Kowalczyk et al. . | |
| 5,539,170 | | 7/1996 | Palmer et al. . | |

* cited by examiner

*Primary Examiner*—Lincoln Donovan
(74) *Attorney, Agent, or Firm*—Martin J. Moran

(57) ABSTRACT

An improved arc chute wrapper for an arc chute of a circuit breaker includes left and right halves that form a conjoined two-part member and that carry a plurality of spaced arc plates thereon. The left and right halves of the wrapper are formed with a plurality of left and right grooves, respectively, in confronting relation when the left and right halves are assembled together. The left and right grooves extend at most only partially into the arc chute wrapper, such that the arc chute wrapper is free of holes extending therethrough in the vicinity of the arc plates. The arc plates are free of spinning tabs extending outwardly therefrom, and rather are securely mounted in the left and right grooves of the wrapper. The arc chute wrapper is manufactured by molding or other appropriate method. The arc chute employing the wrapper of the present invention is more reliable, less expensive, and easier to produce than arc chutes employing wrappers and arc plates of the type heretofore known.

4 Claims, 3 Drawing Sheets

TWO PIECE MOLDED ARC CHUTE

BACKGROUND OF THE INVENTION

1. Field of the Invention

The present invention relates generally to circuit breakers and, more particularly, to an improved arc chute for a circuit breaker. Specifically, the invention is related to an arc chute having arc plates that are mounted in grooves formed in the arc chute wrapper.

2. Description of the Related Art

Numerous types of circuit breakers are known and understood in the relevant art. One of the purposes for which circuit breakers are provided is to interrupt an electrical circuit on command or according to certain criteria. Circuit breakers thus typically include a set of stationary electrical contacts and a set of moveable electrical contacts. The stationary and moveable contacts are in physical contact with one another when it is desired that the circuit breaker provide electricity therethrough to a load. When it is desired to interrupt the circuit, however, the moveable contacts are moved away from the stationary contacts, thus removing the moveable contacts from physical contact with the stationary contacts, creating a space therebetween, and interrupting the circuit.

As is understood in the relevant art, however, the movement of the moveable contacts away from the stationary contacts results in the formation of an electrical arc in the space between the moveable and stationary contacts beginning at the time the moveable and stationary contacts are initially separated. Such an arc is undesirable for a number of reasons. For example, the arc evidences current flowing through the circuit breaker to the load when it is desired that no such current should flow thereto. Additionally, an arc extending between the stationary and moveable contacts often results in vaporization or sublimation of the contact material itself, eventually resulting in destruction or pitting of the moveable and stationary contacts. It is thus desired to eliminate any such arcs as soon as possible upon their propagation.

As is understood in the relevant art, the moveable contacts typically are mounted on pivoting arms that pivot the moveable contacts away from the stationary contacts. An arc chute is provided along the path of each arm to break up and dissipate such arcs. Such arc chutes typically include a plurality of spaced apart arc plates mounted in a wrapper, the arc plates being aligned with the axis about which the arm pivots. As the moveable contact is moved away from the stationary contact, the moveable contact moves past the ends of the arc plates, with the arc being magnetically urged toward and between the arc plates. The arc plates are electrically insulated from one another such that the arc is broken up and extinguished by the arc plates.

Such arc chutes are not, however, without limitation. For instance, arc chutes of the type known and understood in the relevant art have heretofore been manufactured using arc plates formed with spinning tabs extending outwardly therefrom and extending through holes formed in the wrapper. Such spinning tabs and holes are indicated generally at the numerals 27A and 47A, respectively, in FIG. 6 of U.S. Pat. No. 4,963,849 to Kowalczyk et al. The spinning tabs are then compressed to retain the arc plates in fixed relation to the wrapper. The outer surface of the wrapper is then coated with a layer of ceramic paint to eliminate shorts between the compressed spinning tabs of adjacent arc plates. Such shorting can occur when an arc travels through a hole formed in the wrapper to the exterior of the wrapper and thence to another arc plate or to the circuit breaker housing. The aforementioned manufacturing process is less than fully reliable in eliminating shorts.

It is thus desired to provide an arc chute wrapper that overcomes the problems of arc chute wrappers heretofore known in the art and that is relatively simple and inexpensive to manufacture.

SUMMARY OF THE INVENTION

In view of the foregoing, an arc chute wrapper in accordance with the present invention is a two-piece conjoined member formed with a plurality of grooves, the grooves being structured to receive a plurality of spaced apart arc plates. The arc chute wrapper is free of holes extending therethrough, and the arc plates are free of spinning tabs.

An aspect of the present invention is to provide a circuit breaker incorporating an arc chute, the general nature of which can be stated as including a wrapper, the wrapper having an inner surface and an outer surface, the wrapper being formed with a plurality of grooves extending into the wrapper from the inner surface, and a plurality of arc plates, the arc plates being mounted in the grooves.

Another aspect of the present invention is to provide an arc chute wrapper that is structured to extend at least partially around a plurality of arc plates, the general nature of which can be stated as including a generally U-shaped body formed with a plurality of grooves, the grooves being structured to at least partially receive arc plates therein.

Another aspect of the present invention is to provide a method of manufacturing a wrapper for an arc chute of a circuit breaker, the general nature of which can be stated as including the steps of shaping the wrapper into a general U-shape and forming a plurality of grooves in the wrapper.

These and other aspects and advantages of the present invention will be more readily understood from the following description.

BRIEF DESCRIPTION OF THE DRAWINGS

Similar numerals refer to similar parts throughout the specification.

DESCRIPTION OF THE PREFERRED EMBODIMENT

Figure 1:
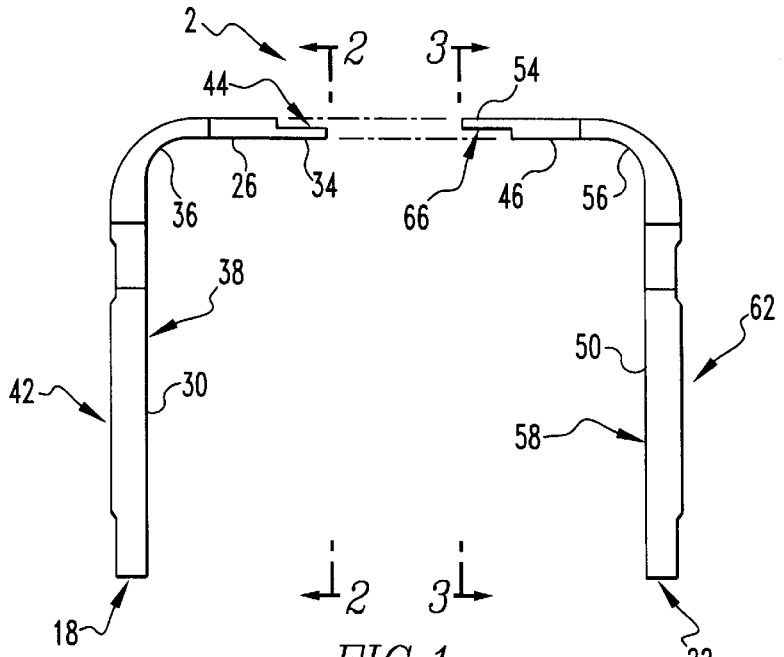
FIG. 1 is top plan view of an arc chute wrapper in accordance with the present invention.

An arc chute wrapper 2 in accordance with the present invention is indicated generally in FIGS. 1–7. The wrapper 2 is a component of an arc chute 6 that includes the wrapper 2 and a plurality of spaced apart arc plates 10. The arc chute 6 is incorporated into a circuit breaker 14 (FIG. 5) and helps to break up and dissipate arcs forming during separation of the moveable contacts from the stationary contacts of the circuit breaker 14.

The wrapper 2 is advantageously a conjoined two-part member including a left half 18 and a right half 22 that are attachable or conjoinable to one another. The left and right halves 18 and 22 are each generally L-shaped, although the left and right halves 18 and 22 can have other combinations of shapes without departing from the spirit of the present invention.

The wrapper 2 is preferably manufactured out of a strong, lightweight material that is electrically insulative or is resistive to the flow of electricity. The material is also preferably capable of being formed by molding, cutting, or other working, and preferably includes a substantial glass component, either in the nature of fibers or granules. While any of a wide variety of appropriate materials may be used, the wrapper is preferably manufactured out of an electrically insulative material that is suited to withstand the elevated temperatures typically experienced in an arc chute application. Such a material would include a compound in accordance with standard GPO-3 as established by the National Electrical Manufacturers Association (NEMA), which is a higher temperature, rigid fiberglass-reinforced polyester thermoset material. Such a material is manufactured by Glastic Corporation of Cleveland, Ohio, 44121 USA. Other appropriate materials may, of course, be used without departing from the concept of the present invention.

The left half 18 includes a left base 26, a left leg 30, and a left tab 34. The left base 26 and left leg 30 are generally planar members that are oriented substantially perpendicular to one another and are connected with one another along an arcuate left transition 36. The left tab 34 protrudes outwardly from the end of the left base 26 opposite the left transition 36.

The left base 26, the left leg 30, and the concave surface of the left transition 36 together define a left inner surface 38. A left outer surface 42 is defined on the left half 18 opposite the left inner surface 38. The left inner surface 38 also extends along the left tab 34, with the left tab 34 including a substantially planar left joining surface 44 that is aligned parallel with and disposed approximately midway between the left inner and outer surfaces 38 and 42 as defined along the left base 26.

The right half 22 includes a right base 46, a right leg 50, and a right tab 54. The right base 46 and right leg 50 are generally planar members that are oriented substantially perpendicular to one another and are attached to one another along an arcuate right transition 56. A right inner surface 58 extends along the right base 46 and right leg 50 and includes the concave surface of the right transition 56. A right outer surface 62 is defined on the right half 22 opposite the right inner surface 58.

The right tab 54 extends outwardly from the end of the right base 46 opposite the right transition 56. The right outer surface 62 extends along the right tab 54, with the right tab 54 including a right joining surface 66, which is a substantially planar surface that is oriented substantially parallel with and disposed approximately midway between the right inner and outer surfaces 58 and 62 as defined along the right base 46.

Figure 2:
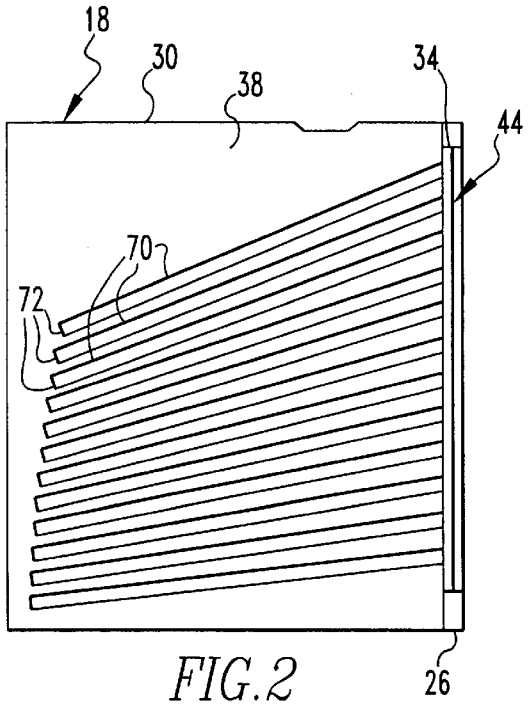
FIG. 2 is a sectional view as taken along line 2—2 of FIG. 1.

As can be seen in FIG. 2, a plurality of left grooves 70 are formed in the left half 18. Specifically, the left grooves 70 extend into the left leg 30 from the left inner surface 38. The left grooves 70 are sized to accommodate and at least partially receive the arc plates 10 therein with minimal clearance. The left grooves 70 each extend along the left leg 30 and terminate at a left retention ledge 72 that is formed in the left leg 30 and is spaced from the outermost end of the left leg 30. The left grooves 70 also terminate at or prior to the left transition 36 and thus do not extend along the left base 26. It is understood, however, that in alternative embodiments the left grooves 70 may be formed along the left transition 36 or additionally along the left base 26 without departing from the spirit of the present invention.

Figure 3:
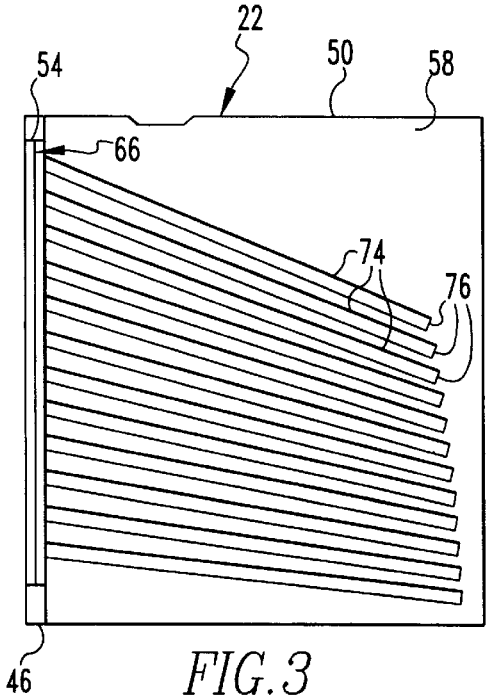
FIG. 3 is a sectional view as taken along line 3—3 of FIG. 1.

Similarly, and as is depicted generally in FIG. 3, a plurality of right grooves 74 are formed in the right half 22. The right grooves 74 extend into the right leg 50 from the right inner surface 58. The right grooves 74 each extend along the right leg 50 and terminate at a right retention ledge 76 that is formed in the right leg 50 and is spaced from the outermost end of the right leg 50. While the right grooves 74 extend along the right leg 50 and terminate at or prior to the right transition 56, it is understood that in alternative embodiments the right grooves 74 may extend along the right transition 56, and may additionally extend along the right base 46 depending upon the specific needs of the particular application.

The inclusion of the left and right retention ledges 72 and 76 makes the left and right grooves 70 and 74 blind grooves, meaning that the left and right grooves 70 and 74 do not terminate at the edges of the left and right legs 30 and 50, but rather terminate prior thereto at the left and right retention ledges 72 and 76. The left and right retention ledges 72 and 76 are retention structures that help to retain the arc plates 10 captured within the left and right grooves 70 and 74 when the left and right halves 18 and 22 are brought together. By providing blind grooves with the left and right retention ledges 72 and 76, the arc plates 10 can be captured between the left and right halves 18 and 22 when brought together without the need for additional retention structures, adhesives, compressive forces on the arc plates 10, and the like, although the use of such would not depart from the spirit of the present invention.

The left and right retention ledges 72 and 76 are preferably integrally formed with and are unitary with the left and right halves 18 and 22. The left and right retention ledges 72 and 76 advantageously retain the arc plates 10 within the left and right grooves 70 and 74 without the need to attach or mount additional structures to the left and right halves 18 and 22 to retain the arc plates 10 thereon, which advantageously reduces expense and the cost of assembly.

Figure 4:
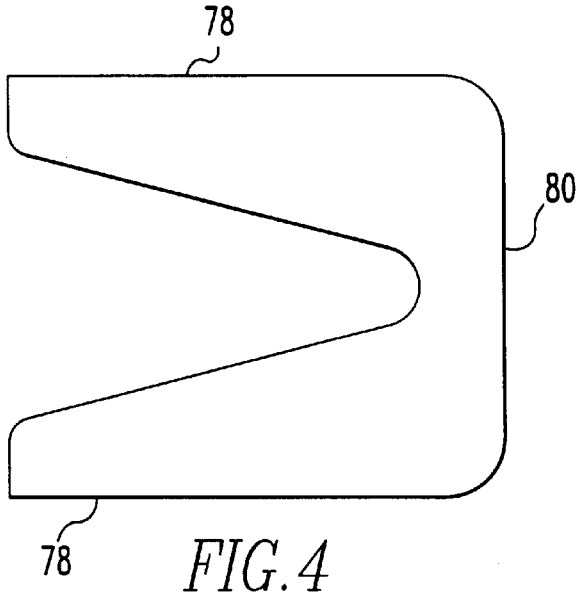
FIG. 4 is a top plan view of an arc plate in accordance with the present invention.

The arc plate 10 depicted generally in FIG. 4 includes a pair of parallel and spaced apart sides 78 that are connected by a head 80 disposed therebetween. The arc plates 10 are generally planar pieces of sheet steel that are, by way of example, 0.062 inches in thickness, although other thicknesses for the arc plates 10 are appropriate depending upon the specific needs of the particular application. The arc plates 10 are preferably plated with chromium to resist corrosion, although other corrosion-resistance methodologies may be employed without departing from the spirit of the present invention.

In assembling the arc chute 6, the arc plates 10 are positioned with respect to one another in a fashion that will enable the ends of the arc plates 10 to be received in the left and right grooves 70 and 74. The left and right halves 18 and 22 are then brought together to capture the arc plates 10 between the left and right halves 18 and 22 and within the left and right grooves 70 and 74. The caption of the arc plates 10 between the left and right halves 18 and within the left and right grooves 70 and 74 secures the arc plates in fixed relation with respect to one another and with respect to the wrapper 2, and additionally obviates any need for additional structures to extend from the arc plates 10 to the left and/or right outer surfaces 42 and 62.

Figure 5:
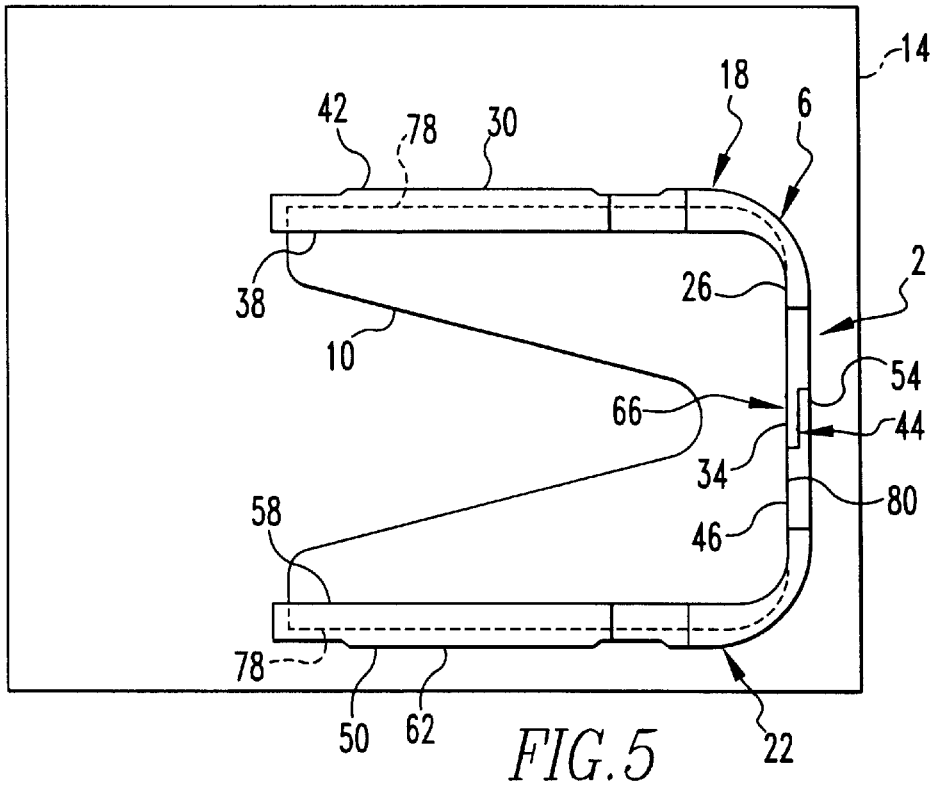
FIG. 5 is a top plan view of an arc chute in accordance with the present invention.
Figure 6:
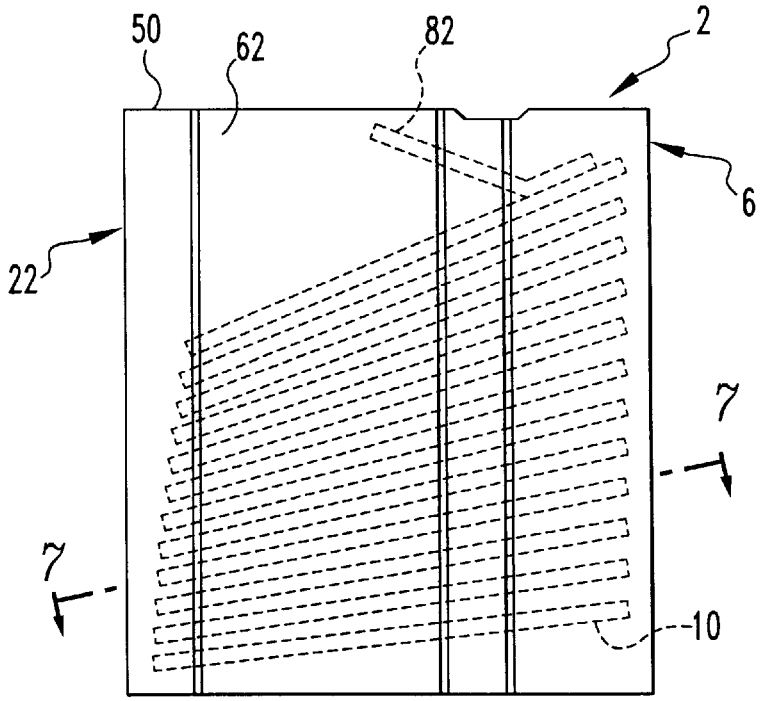
FIG. 6 is a side elevational view of an arc chute in accordance with the present invention.
Figure 7:
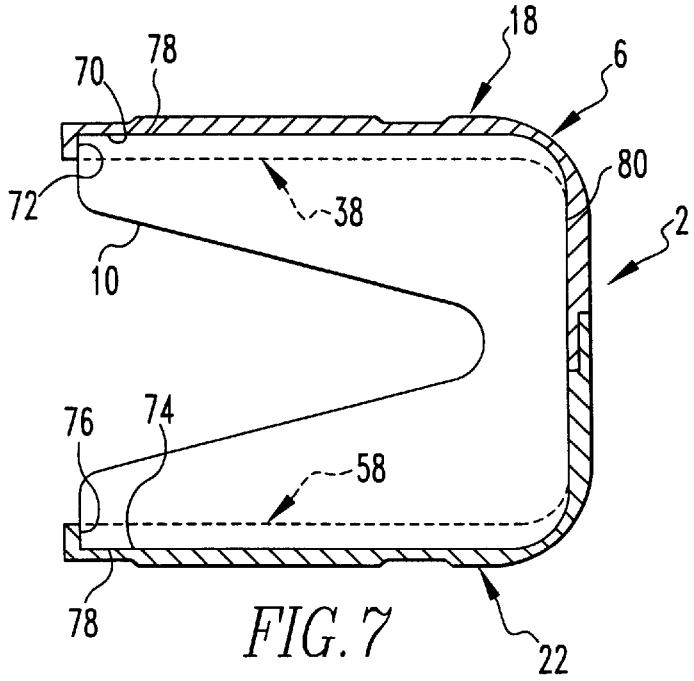
FIG. 7 is a sectional view as taken along line 7—7 of FIG. 6.

The assembled arc chute 6 is indicated generally in FIG. 5. The left half 18 is attachable to the right half 22 by adhering the left tab 34 to the right tab 54. In such position, the left and right tabs 34 and 54 at least partially overlie one another to form a lap joint therebetween. The left and right tabs 34 and 54 are adhered to one another with the left joining surface 44 and the right joining surface 66 in a face-to-face opposed relationship. The left and right tabs 34 and 54 are adhered with an appropriate adhesive of sufficient strength and resilience appropriate to the lo application such as Super Bonder 496 manufactured by Loctite Corporation, North American Group, located at Rocky Hill, Conn. 06067, USA. It is understood, however, that alternate appropriate adhesives may be used without departing from the spirit of the present invention.

When the left and right halves 18 and 22 are conjoined in the aforementioned fashion, the left and right grooves 70 and 74 are in confronting relation with one another such that each left groove 70 has a corresponding right groove 74 aligned therewith. The left and right grooves 70 and 74 are sized to accommodate the sides 78 of the arc plates 20 therein with minimal clearance therebetween. The arc chute 6 is thus assembled by positioning arc plates 10 with the sides 78 thereof disposed in confronting pairs of left and right grooves 70 and 74 such that arc plates 10 occupy all of the left and right grooves 70 and 74. In such position, the heads 80 of the arc plates 10 are disposed against the left and right inner surfaces 38 and 58 of the left and right bases 26 and 46, respectively. In such a configuration, the depths of the left and right grooves 70 and 74 preferably smoothly change from their nominal depths along the left and right legs 30 and 50 to a point of zero depth located generally at the junctures between the left leg and base 30 and 26 and the right leg and base 50 and 46. The depths of the left and right grooves 70 and 74 alternatively may remain constant without the aforementioned change in depth without departing from the spirit of the present invention. The left and right grooves 70 and 74 are blind also in that they terminate at the left and right bases 26 and 46.

In this regard, it is understood that if the left and right grooves 70 and 74 are configured to extend along the left and right transitions 36 and 56, or still additionally along the left and right bases 26 and 46, the arc plates 10 are appropriately disposed therein. Still alternatively, it may be preferable depending upon the specific needs of the particular application to provide a small space between the heads 80 of the arc plates 10 and the left and right inner surfaces 38 and 58 of the left and right bases 26 and 46.

The uppermost arc plate 10 preferably additionally includes an arc horn 82 extending upwardly therefrom for purposes that are understood in the relevant art. The presence or absence of the arc horn 82 does not affect the functionality of the present invention. As is understood in the relevant art, the arc horn 82 is typically attached to the uppermost arc plate 10 by known methods such as spot welding, with the arc plate 10 and arc horn 82 then together being chrome plated and installed into the arc chute 6 along with the other arc plates 10.

When the left and right halves 18 and 22 are conjoined, the wrapper 2 is thus a generally U-shaped member or body that captures the arc plates 10 within the left and right grooves 70 and 74 formed thereon. The wrapper 2 is sufficiently rigid and strong to resist the magnetic forces experienced by the arc plates 10 during propagation, disruption, and dispersion of the arc formed between the movable and stationary contacts of the circuit breaker 14.

In this regard, the left and right halves 18 and 22 are preferably formed by molding such that the glass contents of the wrapper 2 are molded around the left and right grooves 70 and 74. As is understood in the relevant art, formation of the left and right halves 18 and 22 by a molding process facilitates molding of the glass contents of the wrapper 2 along and around the left and right grooves 70 and 74 for the greatest strength. It is understood, however, that the left and right grooves 70 and 74 can be formed in the left and right halves 18 and 22 by other methodologies, such as by cutting, grinding, milling, and the like, depending upon the specific needs of the particular application, and without departing from the spirit of the present invention.

It is also understood that the configuration of the wrapper 2 with the left and right halves 18 and 22 may be varied as needed, depending upon the specific needs of the particular application. For instance, the wrapper 2 may be configured as a single unit that is molded around the arc plates 10 that are held in a given position by a fixture. It is additionally understood that the joining of the left and right halves 18 and 22 by lapping and adhering the left and right tabs 34 and 54 can be accomplished in other fashions, such as by heat welding and other appropriate attachment methodologies.

With the arc chute 6 assembled as such, the arc plates 10 are electrically insulated from one another and additionally are insulated from the left and right outer surfaces 42 and 62. Such electrical insulation and isolation results from spacing the arc plates 10 away from one another and by configuring the left and right grooves 70 and 74 to extend at most only partially into the left and right halves 18 and 22, respectively. In this regard, it can be seen that the left and right halves 18 and 22 are free of holes extending therethrough between the inner and outer surfaces thereof. More specifically, the left and right halves 18 and 22 are free of holes extending between the left inner and outer surfaces 38 and 42 and between the right inner and outer surfaces 58 and 62 in the vicinity of the arc plates 10. The absence of any such holes facilitates and enhances the electrical insulation and isolation of the arc plates 10 from one another.

In this regard, the arc chute 6 need not be painted with ceramic paint after assembly of the arc plates 10 in the wrapper 2. The arc chute wrapper 2 being free of ceramic paint thus advantageously simplifies assembly of the arc chute 6 and reduces the cost thereof.

The configuration of the wrapper 2 without holes extending therethrough for receiving spinning tabs simplifies the configuration of the wrapper 2 and increases the strength thereof. Additionally, the configuration of the arc plates 10 without spinning tabs extending outwardly therefrom simplifies the tooling used to stamp the arc plates 10 out of stock material and increases the life of such tooling inasmuch as failures of such tooling most often occur at the spinning tab portions. The configuration of the wrapper 2 with the left and right grooves 70 and 74 thus reduces tooling costs by reducing tooling complexity and by increasing tool life.

The arc chute wrapper 2 of the present invention thus increases the simplicity of the arc chute 6, reduces the cost thereof, and increases the overall strength and reliability thereof. The enchanced reliability of the arc chute 6 increases the overall reliability of the circuit breaker 14, which is highly beneficial in applications requiring the circuit breaker 14 to operate reliably under overload and other conditions.

While particular embodiments of the present invention have been described herein, it is understood that various changes, additions, modifications, and adaptations may be made without departing from the scope of the present invention, as set forth in the following claims.

What is claimed is:

1. In an improved circuit breaker of the type incorporating an are chute, the arc chute including a wrapper and a plurality of arc plates, the improvement comprising:

the wrapper being a conjoined two-piece member including a left half and a right half, the wrapper being generally U-shaped and having an inner surface and an outer surface, the wrapper being formed with a plurality of grooves extending into the wrapper from the inner surface;

the arc plates being disposed in the grooves;

wherein the grooves are in each of the left and right halves and are at lest partially in confronting relation, and the arc plates being captured between the left and right halve and;

wherein the right half includes a right tab and the left half includes a left tab, the right and left tabs at least partially overlying one another.

2. In an improved circuit breaker of the type incorporating an arc chute, the arc chute including a wrapper and a plurality of arc plates, the improvement comprising:

the wrapper being a conjoined two-piece member including a left half and a right half, the wrapper being generally U-shaped and having an inner surface and an outer surfaces, the wrapper being formed with a plurality of grooves extending into the wrapper from the inner surface;

the arc plates being disposed in the grooves;

wherein, the grooves are in each of the left and right halves and are at least partially in confronting relation, and the arc plates being captured between the left and right halves and;

wherein, one of the left and right halves is generally L-shaped.

3. An arc chute wrapper, comprising:

a generally U-shaped body having a plurality of grooves formed therein, at least one end of each groove being blind, the grooves being at least partially in confronting relation and being structured to at least partially receive the arc plates therein;

wherein, the U-shaped body is a conjoined two-part member having a left half and a right half, the grooves being in each of the left and right halves; and wherein, at least one of the left and right halves is generally L-shaped.

4. An arc chute wrapper, comprising:

a generally U-shaped body having a plurality of grooves formed therein, at least one end of each groove being blind, the grooves being at least partially in confronting relation and being structured to at least partially receive the arc plates therein;

wherein the U-shaped body is a conjoined two-part member having a left half and a right half, the grooves being in each of the left and right halves;

wherein each of the left and right halves includes a tab, the tabs at least partially overlying one another when the left and right halves are conjoined.

* * * * *